US009212038B1

(12) United States Patent
Presti

(10) Patent No.: US 9,212,038 B1
(45) Date of Patent: Dec. 15, 2015

(54) AUTOMATED PORTABLE PERSONAL LIFT

(71) Applicant: Kelly Presti, Fairview, TX (US)

(72) Inventor: Kelly Presti, Fairview, TX (US)

( * ) Notice: Subject to any disclaimer, the term of this patent is extended or adjusted under 35 U.S.C. 154(b) by 0 days.

(21) Appl. No.: 14/508,061

(22) Filed: Oct. 7, 2014

(51) Int. Cl.
*E04G 1/22* (2006.01)
*B66F 11/04* (2006.01)
*B66F 17/00* (2006.01)

(52) U.S. Cl.
CPC ..... *B66F 11/042* (2013.01); *B66F 11/04* (2013.01); *B66F 17/006* (2013.01); *E04G 1/22* (2013.01)

(58) Field of Classification Search
CPC ..... E04G 1/22
USPC ..... 182/14, 148, 69.5, 69.6
See application file for complete search history.

(56) References Cited

U.S. PATENT DOCUMENTS

| | | | | | |
|---|---|---|---|---|---|
| 2,183,679 | A | * | 12/1939 | Hillis | 182/14 |
| 2,762,659 | A | * | 9/1956 | Harlan et al. | 182/141 |
| 3,180,450 | A | * | 4/1965 | Crager et al. | 182/14 |
| 3,614,993 | A | * | 10/1971 | Penso | 182/16 |
| 3,963,096 | A | | 6/1976 | Jones | |
| 4,073,388 | A | * | 2/1978 | Carter | 414/796.7 |
| 4,088,202 | A | * | 5/1978 | Costello | 182/13 |
| 4,114,854 | A | * | 9/1978 | Clark | 254/122 |
| 4,592,590 | A | | 6/1986 | Slaats et al. | |
| 4,682,750 | A | | 7/1987 | Rudolph et al. | |
| 5,228,534 | A | * | 7/1993 | Haroldson, Sr. | 182/63.1 |
| 5,310,018 | A | * | 5/1994 | Lahaie | 182/141 |
| 5,322,408 | A | | 6/1994 | Wooden | |
| 5,461,736 | A | | 10/1995 | Carpenter et al. | |
| 6,174,124 | B1 | * | 1/2001 | Haverfield et al. | 414/642 |
| 6,651,775 | B2 | | 11/2003 | Bassett, Jr. | |
| 6,871,364 | B1 | | 3/2005 | Leoutsakos | |
| 7,070,167 | B1 | | 7/2006 | Bacon et al. | |
| 2004/0035636 | A1 | * | 2/2004 | Julien | 182/69.6 |
| 2009/0180843 | A1 | | 7/2009 | Jackson et al. | |
| 2009/0188754 | A1 | | 7/2009 | Warren et al. | |
| 2009/0252586 | A1 | * | 10/2009 | Sumiyoshi et al. | 414/685 |
| 2011/0214942 | A1 | | 9/2011 | Niemiec | |

FOREIGN PATENT DOCUMENTS

| | | | |
|---|---|---|---|
| EP | 1366692 | A2 | 12/2003 |
| GB | 1358384 | A * | 7/1974 |

* cited by examiner

*Primary Examiner* — Alvin Chin-Shue
(74) *Attorney, Agent, or Firm* — Vincent J. Allen; James H. Ortega; Carstens & Cahoon, LLP

(57) ABSTRACT

The disclosed principles provide a personal moveable, automated lift mechanism. In one embodiment of an automated personal lift as disclosed herein, the lift may comprise an outer frame comprising a horizontal base support and an outer handrail supported above a perimeter of the horizontal base support by a plurality of outer vertical supports coupled to the horizontal base support, the outer handrail comprising a first opening having a width sufficient for a human user to step through. Such an exemplary lift may also comprise an inner frame positioned within the outer frame and comprising a horizontal platform configured to support the user and an inner handrail supported above a perimeter of the platform by a plurality of inner vertical supports coupled to the platform, the inner handrail comprising a second opening aligned with the first opening in the outer handrail.

19 Claims, 10 Drawing Sheets

AUTOMATED PORTABLE PERSONAL LIFT

TECHNICAL FIELD

The disclosed principles pertain, generally, to portable equipment, and more particularly to a portable automated personal lift for use in the home and other locations, and sized for hidden storage within a cabinet space.

BACKGROUND

A recurring problem faced daily by any number of people is the placing and removing of items in storage spaces that are at a height out of reach of the typical person. For example, the kitchen is often a place in a person's home where persons in the home may not be able to reach items stored at upper heights. This could include the upper shelves in tall kitchen cabinets, or even decorative space often found above kitchen cabinets. Other places where a person may need to reach high locations are high storage cabinets or shelves in a garage or closet.

Besides the home, similar situations often occur in both retail and industrial locations. For example, display racks in stores are often constructed tall enough where reaching up areas is difficult or impossible for typical persons without some type of assistance. Similarly, storage areas in the stock rooms of retail stores are often quite tall, thus requiring persons to obtain a ladder or portable steps in order to reach upper locations.

However, obtaining a ladder and carrying it to the desired location is often difficult, cumbersome, and possibly even dangerous, either because of the weight the ladder or its sheer size. In some cases it may even be impossible due to the length of the ladder needed to reach a desired storage space. Similarly, acquiring portable steps or another similar apparatus may also be difficult and cumbersome, or perhaps such an apparatus is generally too expensive or too large to store in or near the building or structure where the upper storage space is located. Exacerbating these issues is the availability and mobility of such an apparatus that is automated to lift a user to desired height. Conventional automated devices include the use of forklifts, but these are certainly too large and expensive for the majority of people to keep nearby, especially when the upper storage spaces are in a typical home. Accordingly, what is needed in the art is a mechanical, automated lift capable of reaching extremely high storage spaces, yet is small enough, portable enough, and cost-effective enough for average persons to own and store in their home or other location. The disclosed principle provide such a solution.

SUMMARY

The disclosed principles provide a personal moveable, automated lift mechanism for use in places like a user's home to reach heights not commonly reachable by the user. The disclosed lift is inexpensive as compared to other automated devices for raising an individual to a desired height, and is sized compact enough to easily and discretely store in a user's home. However, the disclosed lift is still sturdy enough to safely raise a user to at least about twice the height of the lift in the fully lowered position, as well as for repeated use year after year. The disclosed principles also provide for means by which the automated personal lift may be discretely stored, such as a false kitchen cabinet camouflaged to hide and stored the lift, but also quickly accessible for use by a user.

In one embodiment of an automated personal lift as disclosed herein, the lift may comprise an outer frame comprising a horizontal base support and an outer handrail supported above a perimeter of the horizontal base support by a plurality of outer vertical supports coupled to the horizontal base support, the outer handrail comprising a first opening having a width sufficient for a human user to step through. Such an exemplary lift may also comprise an inner frame positioned within the outer frame and comprising a horizontal platform configured to support the user and an inner handrail supported above a perimeter of the platform by a plurality of inner vertical supports coupled to the platform, the inner handrail comprising a second opening aligned with the first opening in the outer handrail. In addition, the lift may include an automated lifting mechanism coupling the outer frame to the inner frame, and configured to raise and lower the inner frame with respect to the outer frame. Also included may be at least one guide moveably connecting the outer frame to the inner frame, the at least one guide configured to provide horizontal stability between the outer and inner frames during the raising and lowering. Such embodiments may further include a plurality of friction reducing members attached to the base support and configured to allow the lift to be moved to a different location by the user.

In another embodiments, a portable automated personal lift in accordance with the disclosed principles may comprise an outer frame comprising a horizontal base support and an outer handrail supported above a perimeter of the base support by a plurality of outer vertical supports coupled to the base support, the outer handrail comprising a first opening having a width sufficient for a user to step through. Such an exemplary lift may also comprise an inner frame positioned within the outer frame and comprising a horizontal platform configured to support the user and an inner handrail supported above a perimeter of the platform by a plurality of inner vertical supports coupled to the platform, the inner handrail comprising a second opening aligned with the first opening in the outer handrail. In addition, the lift may include an automated scissor-lift mechanism coupling the outer frame to the inner frame and configured to raise and lower the inner frame with respect to the outer frame. Such embodiments may further include at least one guide moveably connecting the outer frame to the inner frame, the at least one guide configured to provide horizontal stability between the outer and inner frames during the raising and lowering. Furthermore, such exemplary lifts may include a plurality of wheels attached to the base support and configured to allow the lift to be moved to a different location by the user, at least one of the wheel members comprising a locking mechanism configured to prevent rolling of the wheel when in a locked position.

BRIEF DESCRIPTION OF THE DRAWINGS

Exemplary embodiments of the disclosed principles are described herein with reference to the following drawings, in which like numerals identify similar components, and in which.

DETAILED DESCRIPTION

The disclosed principles provide a personal moveable, automated lift mechanism for use in places like a user's home to reach heights not commonly reachable by the user. For example, the kitchen is often a place in a user's home where persons in the home may not be able to reach items stored at upper heights. This could include the upper shelves in tall kitchen cabinets, or even decorative space often found above kitchen cabinets. The disclosed lift may also be employed in other locations, such as high storage cabinets or shelves in a garage or closet. Additionally, the disclosed lift is compact in size when in its lowered position, which allows discrete storage of the lift when not in use. Moreover, the disclosed lift is inexpensive for the average homeowner to own and use around the house or other similar location. Exemplary embodiments of the disclosed lift are presented below with reference to the accompanying figures.

Figure 1:
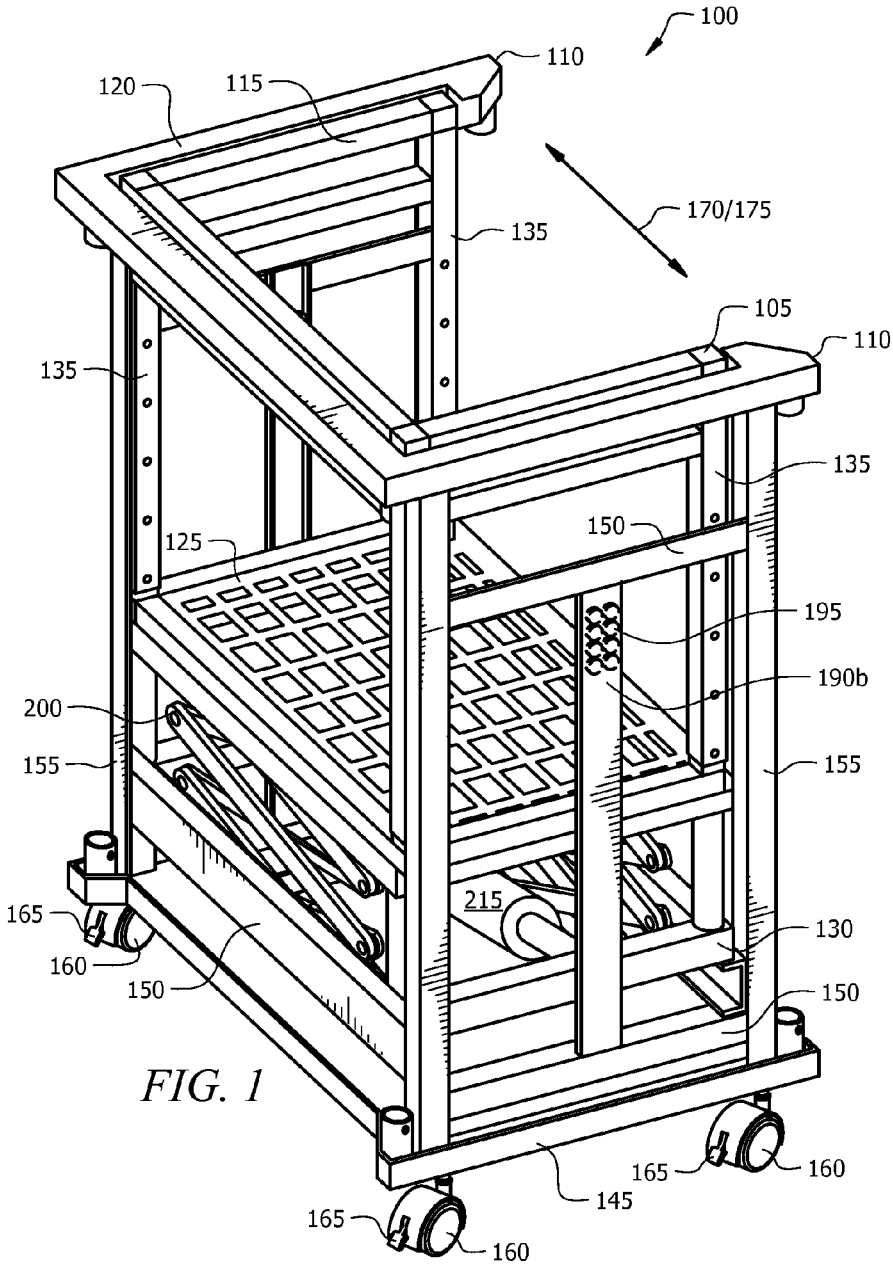
FIG. 1 illustrates an isometric view of an exemplary embodiment of mechanical lift in accordance with the disclosed principles in the fully lowered position.

FIG. 1 illustrates an isometric view of an exemplary embodiment of mechanical lift 100 in accordance with the disclosed principles in the fully lowered position. The fully lowered position of the lift 100 is low enough to allow a typical user to step onto the lift 100 for being lifted upwards a desired height. In advantageous embodiments, the lift 100 is constructed primary of strong materials, such as aluminum, steel or other metals, but specialized materials may also be employed for constructing the structural components of the lift 100. For example, if the lift 100 is to me used in food preparation areas, such as in a restaurant or the medical field in a physician's office or a hospital environment, the lift 100 may be constructed primarily of stainless steel. Of course, other materials, whether metals or not, such as strong plastics or the like, may also be employed depending on the specific application of the lift 100 by a user.

As illustrated, this exemplary embodiment of the mechanical lift 100 includes both an inner frame 105 and an outer frame 110, with the inner frame 105 sized and configured to be received within the perimeter of the outer frame 110. In this embodiment, the inner and outer frames 105, 110 are rectangular-shaped, with the inner frame 105 being slightly smaller in length and width than the outer frame 110.

In addition, overall heights of the inner and outer frames 105, 110 may also be substantially equal in such embodiments when the lift is in the fully lowered position. For example, the inner frame 105 may include an inner handrail 115 and the outer frame 110 may include an outer handrail 120, and those handrails 115, 120 may be aligned when the lift 100 is in the fully lowered position, as illustrated. In such embodiments, the height of the handrails 115, 120 may be selected such that a user may comfortably and naturally grasp the handrails 115, 120 without undue effort. Accordingly, when a user steps onto the lift 100, the user can instinctively grasp the handrails 115, 120 for balance and support when mounting the lift 100 for use.

Of course, in other embodiments, the outer frame 110 may not include a handrail, and instead may simply be upper support members 120 attached to the upper ends of the outer frame 120. In such embodiments, the height of the upper supports of the outer frame 110 may not be formed at the same height or in alignment with the handrail 115 of the inner frame 105. In these embodiments, the upper supports would simply be employed to provide structural stability and support for upper area of the outer frame 120. Thus, in these embodiments, when a user mounts the lift 100 for use, the user would simply grasp the handrail 115 of the inner frame 105 for balance and support during use of the lift 100.

The inner frame 105 in the embodiment illustrated in FIG. 1 further includes a platform 125 on which a user stands when using the lift 100. The platform 125 may be covered with any of a number of materials, including carpeting, rubber or other padded, non-slip material, or even sheet metal, expanded metal or other similar rigid materials. The platform 125 may be supported by a platform frame 130, as also shown in this illustrated embodiment. The platform frame 130 may be constructed of one or more frames of tubular steel or other rigid material sufficient for supporting the platform 125 and the weight of the user. Cross-members may also be provided under central portions of the platform 125, as needed.

The inner frame 105 may further include vertical support members 135 extending upward to define outer edges of the inner frame 105 and ultimately supporting the inner handrail 115. In the illustrated embodiment, the inner frame 105 is rectangular in shape, and thus the vertical support members 135 may be positioned at the corners of the inner frame 105. However, in other embodiments of the inner frame 105, the support members 135 may be positioned at other structurally sound locations. In addition, optional balusters 140 (see FIG. 4) may be provided in the spaces between the vertical support members 135. Although the inner handrail 115 and the vertical support members 135 can provide an adequate safety enclosure for a user employing the lift 100, including the optional balusters 140 may provide a further enhanced safety enclosure for a user employing the lift 100. In other embodiments, transparent or semi-transparent panels may be included in place of the balusters 140, but would still provide sufficient enclosure for the lift 100 when employed by a user.

The outer frame 110 may also be constructed with a base support frame 145 that defines the perimeter of the base of the outer frame 110. In the illustrated embodiment, the outer frame 110 is also a rectangular shaped enclosure, and thus the base support frame 145 can define the perimeter of this rectangular shape. Additional horizontal supports 150 may also be provided proximate to the base of the outer frame 110 for additional strengthening of the outer frame 110. Such supports 150 may be located in any of a number of positions at the base of the outer frame 110, and those skilled in the pertinent field of art will understand advantageous locations for such base supports 150. Outer vertical support members 155 extend from the base support frame 145 upwards towards the outer handrail 120. These outer vertical support members 155 may define the inner edges of the outer frame 110 and thus may be embodied in angled metal, or other similar structure. In addition, additional outer supports 157 (see FIG. 4) may also be provided to increase the strength of the outer frame 110 and the support the outer handrail 120, and may also define the outer edges of the outer frame 110. As with the inner frame 105, when the outer frame 110 is rectangular in shape, the outer vertical support members 155, 157 may be positioned at the corners of the outer frame 110. However, in other embodiments having other shapes for the outer frame 110, the outer vertical support members 155, 157 may be positioned at other structurally sound locations of the outer frame 110. Also as with the inner frame 105, optional balusters 140 may be provided in the spaces between the outer vertical support members 155, 157 when desired.

Attached to the base support frame 145 may be wheels 160 that permit the lift 100 to be easily moved by a user. The wheels 160 may be rotating casters or any other friction reducing members that permit moving the lift 100 by a user. For example, reduced friction sliders, which may include Teflon® or another similarly slick material, may instead be used on the base of the lift 100. As such, any type of friction reducing member may be employed with the disclosed principles without departing from the broad scope of these principles. Moreover, a locking mechanism 160 may be included on one or more of the wheels 160 or other friction reducing members, as illustrated. Such locking mechanisms 165 can be used to prevent movement of the lift 100 once activated, which enhances the safety of the lift 100 when in use. Moreover, the locking mechanisms may be automated with respect to use of the lift 100. For example, they may be configured to lock one or more of the wheels 160 in place when a predetermined amount of weight is placed on the platform 125. For example, the members 160 may be spring-loaded so that the friction-reducing surface of the members 160 is prevented from contacting the floor when the weight is placed on the platform 125. Alternatively, the locking mechanisms 165 may be electric such that they are activated when power is provided to operate the lift 100. Still further, they may be manually lockable by the user, either by physically manipulating one or more of the locking mechanisms 165, or even by an electric activation switch mounted on or proximate to the lift 100. Of course, other activation means may also be provided in accordance with the disclosed principles.

As illustrated, the outer frame 110 includes an outer opening 170 on one side of the lift 100, which allows a user to step through the opening 170 to mount the lift. The vertical structural supports of the outer frame 110 may be designed and constructed to provide sufficient structural support for the side of the outer frame 110 that includes the walk-through opening. Those skilled in the art will understand the type of structural design and material that may be employed in accordance with the disclosed principles in order to maintain strength on the side of the outer frame 110 with the outer opening 170.

The inner frame 105 also includes inner opening 175 on one of its sides, which is also sized for allowing a user to walk through when mounting the lift 100. As illustrated, the inner opening 175 is aligned with and is substantially coextensive with the outer opening 170 of the outer frame 110. For example, the openings 170, 175 may be formed to about 24 inches, but of course any advantages widths can also be provided with the disclosed lift 100. In addition, the vertical structural supports 135 surrounding the inner opening 175 may be designed and constructed to provide sufficient structural support for the side of the inner frame 105 that includes that walk-through opening 175. As before, any type of structural design and material may be employed in accordance with the disclosed principles in order to maintain strength on the side of the inner frame 105 with the inner opening 175.

In addition to the inner opening 175, the inner frame 105 may also include an enclosing feature 180, for example a bar, a gate, or even a rope or chain extending across the inner opening 175. Of course, any type of enclosing feature 180 (see FIG. 3) may be provided with a lift 100 according to the principles disclosed herein. The enclosing feature 180 may be provided for enhancing a user's safety when mounting the lift 100 for use. For example, in advantageous embodiments, the enclosing feature 180 may be provided at or around the same height as the inner handrail 115, as illustrated. The enclosing feature 180 may be as simple as a removable chain 180 (see FIG. 3). In other embodiments, a gate structure 180 employed for the enclosing feature (see FIG. 4), which may or may not also include optional balusters 140, if desired, to further enhance the safety of the disclosed lift 100. Furthermore, the enclosing feature 180 can include a latching mechanism 185 (see FIG. 4), such as a hook and bar (as is found on a yard gate) or a spring-loaded retractable latch (as is used with a typical door knob). In addition, more complex latching mechanisms 185 may also be included to further enhance safety, such a mechanism that requires manipulation by a user is multiple directions before it may be opened. Accordingly, any type of latching mechanism 185 may be provided with a lift 100 constructed as disclosed herein, and no limitation to any particular type of latching mechanism, or even enclosing feature 180, is implied herein or should be inferred from this disclosure.

As shown in the illustrated embodiment of FIG. 1, physically connecting the inner frame 105 to the outer frame 110 are a pair of guiderails 190*a*, 190*b*. The guiderails 190*a*, 190*b* are employed in this embodiment to align the movement of the inner frame 105 upward and downward with respect to the outer frame 110 during use of the lift 100. In addition, the guiderails 190*a*, 190*b* provide horizontal stability between the two frames 105, 110 as the inner frame 105 is raised and lowered. As shown, a male or female rail of the guiderails 190*a*, 190*b* is connected to the inner frame 105, while a complimentary rail is connected to the outer frame 110, such that the male rail moves within the female rail as the inner frame 105 moves. Such movement between the rails may be a sliding movement, but in other embodiments the guiderails 190*a*, 190*b* may include internal rollers 195, such as ball bearings, placed between a male and female rail such that friction between the two rails is substantially eliminated during movement. Of course, other interconnection techniques between the complimentary rails of the guiderails 190*a*, 190*b*.

In other embodiments, instead of or in addition to the guiderails 190*a*, 190*b*, one or more of the outer corners of the inner frame 105 may be configured to engage inner surfaces of the corners of the outer frame 110, for example, to provide a sliding relationship between the two frames 105, 110 during use of the lift 100. Moreover, rather than a sliding relationship between these sets of corners, rollers or other interconnection means may provide the moveable relationship between the two frames 105, 110 in such embodiments. Still further, other embodiments of a lift 100 according to the disclosed principles may include still other interconnection mechanisms between the inner and outer frames 105, 110 that also provide continuous alignment and stability between the two frames 105, 110 during raising and lowering of the lift 100. Accordingly, no limitation to any particular interconnect between the inner and outer frames 105, 110 should be inferred from the present disclosure.

The lifting mechanism 200 in the embodiment of the lift 100 illustrated in FIG. 1 is a "scissor type" or "scissor lift" mechanism 200. This type of lifting mechanism 200 comprises the use of linked, folding supports 205 in a criss-cross "X" pattern, known as a "pantograph." The pantograph is a mechanical linkage connected in a manner based on parallelograms so that the movement at one end of the linkage is produces identical movements at the opposing end of the linkage. The upward motion of the inner frame 105 for the lift 100 is achieved by the application of pressure to the outside of the lowest set of supports 205, which in turn elongates the crossing pattern of folding supports 205 and vertically propels the platform 125 since it is connected to the outside of the uppermost set of supports 205. In addition to the criss-crossing supports 205, pantograph support members 210*a*, 210*b* (see FIG. 4) may also be included if needed, which may provide horizontal support for the pantograph lift mechanism 200 during use of the lift 100, particularly the higher that the inner frame 105 rises during use. Additional or alternative support members may also be included to provide stability to the pantograph lift mechanism 200, as desired, and those who are skilled in the pertinent field of art will understand that such additional or alternative support means may be included in a lift 100 as disclosed herein, without departing from the broad scope of the disclosed principles.

The power system 215 employed to operate the scissor-based lifting mechanism 200 of the lift 100 may be selected from any of a number of possibilities. Exemplary embodiments can include a power system 215 based on fluid or mechanical power. For example, fluid-based power systems may be hydraulic or pneumatic based, and employ a ram and piston mechanism for powering the supports 205. Mechanical-based power systems may be based on a leadscrew or a rack and pinion system for powering the supports 205. Of course, other types of power systems may also be employed, and the disclosed principles are not limited to any particular means of power. When a fluid-based power system 215 is employed with the lift 100, lowering the inner frame 105 may require no power, and instead can employ a simple release of hydraulic or pneumatic pressure. Such advantageous embodiments allow a fail-safe option of returning the inner frame 105, and hence the user, to the lowered level by simple release of a manual valve.

It should be understood that although figures provided herein illustrate the lifting mechanism as a scissor-type mechanism, in alternative embodiments, the lifting mechanism for the a lift constructed in accordance with the disclosed principles may be provided as any other type of lifting mechanism capable of providing the raising and lowering of the inner frame 105. For example, in some embodiments, the lifting mechanism may be a plurality of leadscrews, perhaps located on the interiors of the corners of the outer frame 110, to drive the platform 125 up and down. More specifically, in such embodiments, the inner frame 105 may include threaded receivers for the plurality of leadscrews that translate up and down the leadscrews while they rotate clockwise and counter-clockwise to raise and lower the inner frame 105. The leadscrews can be configured to turn simultaneously with a collection of gears or pulleys coupled to the base of the leadscrews and driven by one or more motors.

In yet other embodiments, the lifting mechanism may be provided as a rack and pinion system directly mounted between the inner and outer frames 105, 110. For example, racks having teeth may be provide on, for example, portions of the inner frame 115 such as proximate the corners of the inner frame 105 where they meet the corners of the outer frame 110. Pinion gears, mounted to the outer frame 110, may then be provided to engage the teeth of corresponding racks, while a power system, such as a motor driving each pinion gear, either directly or via a transmission mechanism, is used to translate the racks. As the racks are translated by the pinion gears, which are mounted to the outer frame 110, will cause the inner frame 105 to move in the up and down directions. A lesser number of motors driving the pinion gears may also be employed, where a collection of gears or pulleys is used to provide the drive force to the pinion gears. In short, other configurations for lifting mechanisms may also be provided within the broad scope of the disclosed principles, and thus a lift 100 as constructed herein is not limited to any particular type of lifting mechanism.

Figure 2:
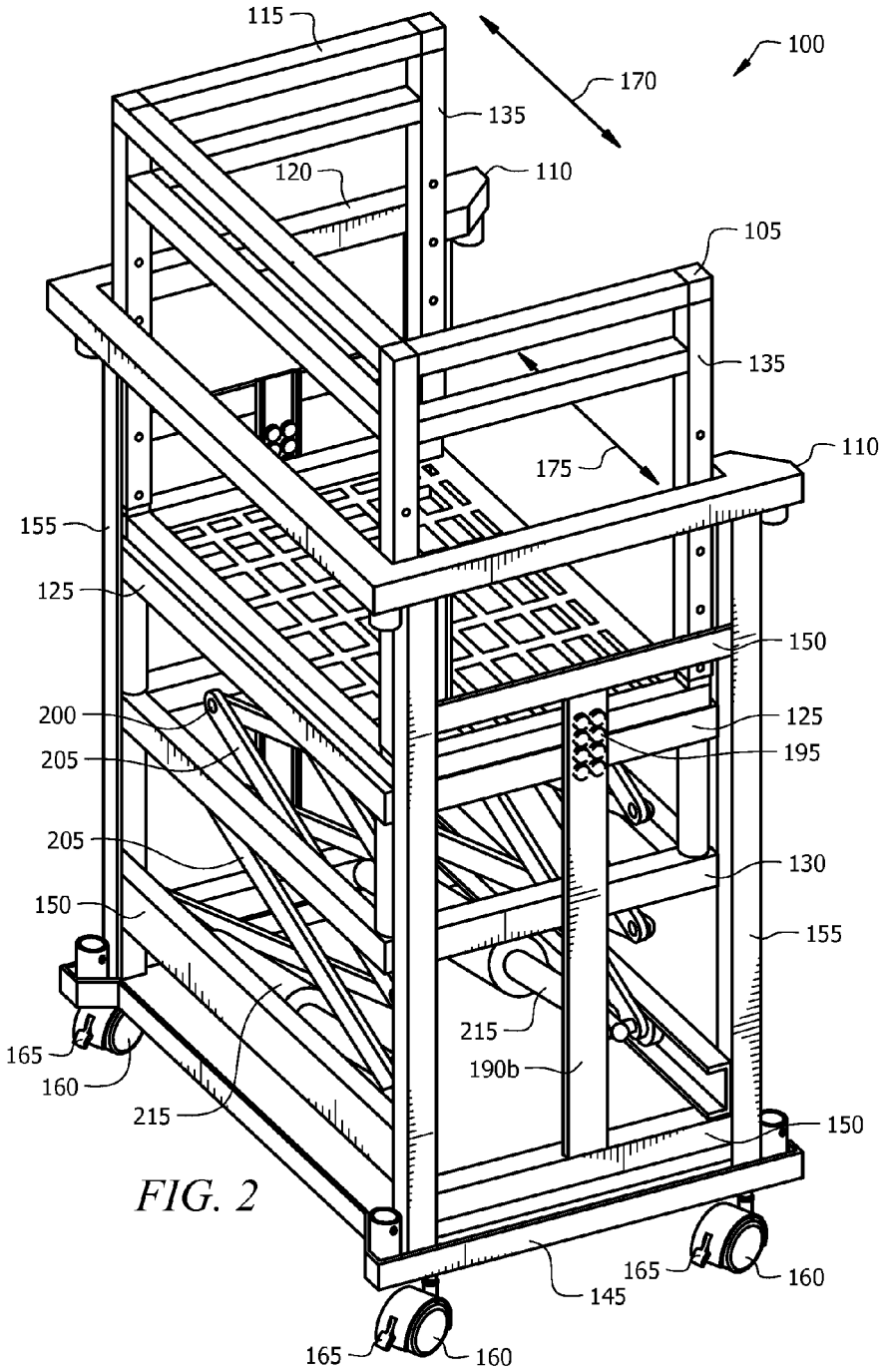
FIG. 2 illustrates an isometric view of an exemplary embodiment of mechanical lift in accordance with the disclosed principles at an intermediate position between the fully lowered and fully raised positions.

Turning to FIG. 2, illustrated is the lift 100 partly between a fully raised and fully lowered position. As shown, the scissor-lift mechanism 200 extends in order to lift the platform 125 to the desired height. In addition, the interconnection between the inner frame 105 and the outer frame 110 during operation of the lift 100 can be seen in the illustration of FIG. 2. However, as mentioned above, other configurations for lifting mechanisms may also be provided within the broad scope of the disclosed principles. In advantageous embodiments, the lift 100 is not required to translate from the fully lowered position to the fully raised position and vice versa. Instead, a lift 100 in accordance with the disclosed principles may be raised or lowered to any desired position between to the two extremes, and safely held at the intermediate height until a different height is desired. Of course, other embodiments of the disclosed lift 100 may be specifically configured to only move from the fully lowered position to the fully raised position and vice versa, if such an embodiment is desired.

Figure 3:
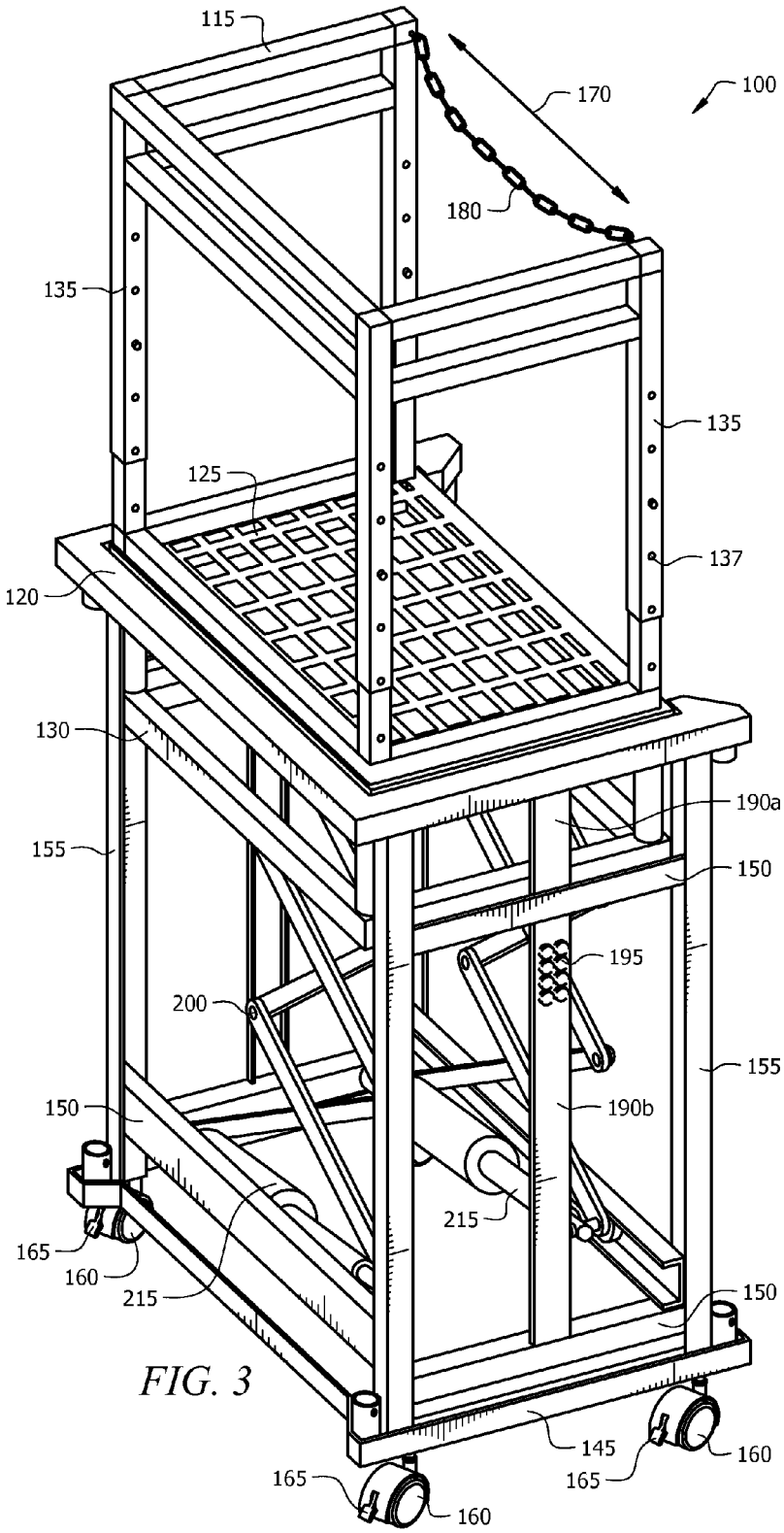
FIG. 3 illustrates an isometric view of an exemplary embodiment of mechanical lift in accordance with the disclosed principles in the fully raised position.
Figure 4:
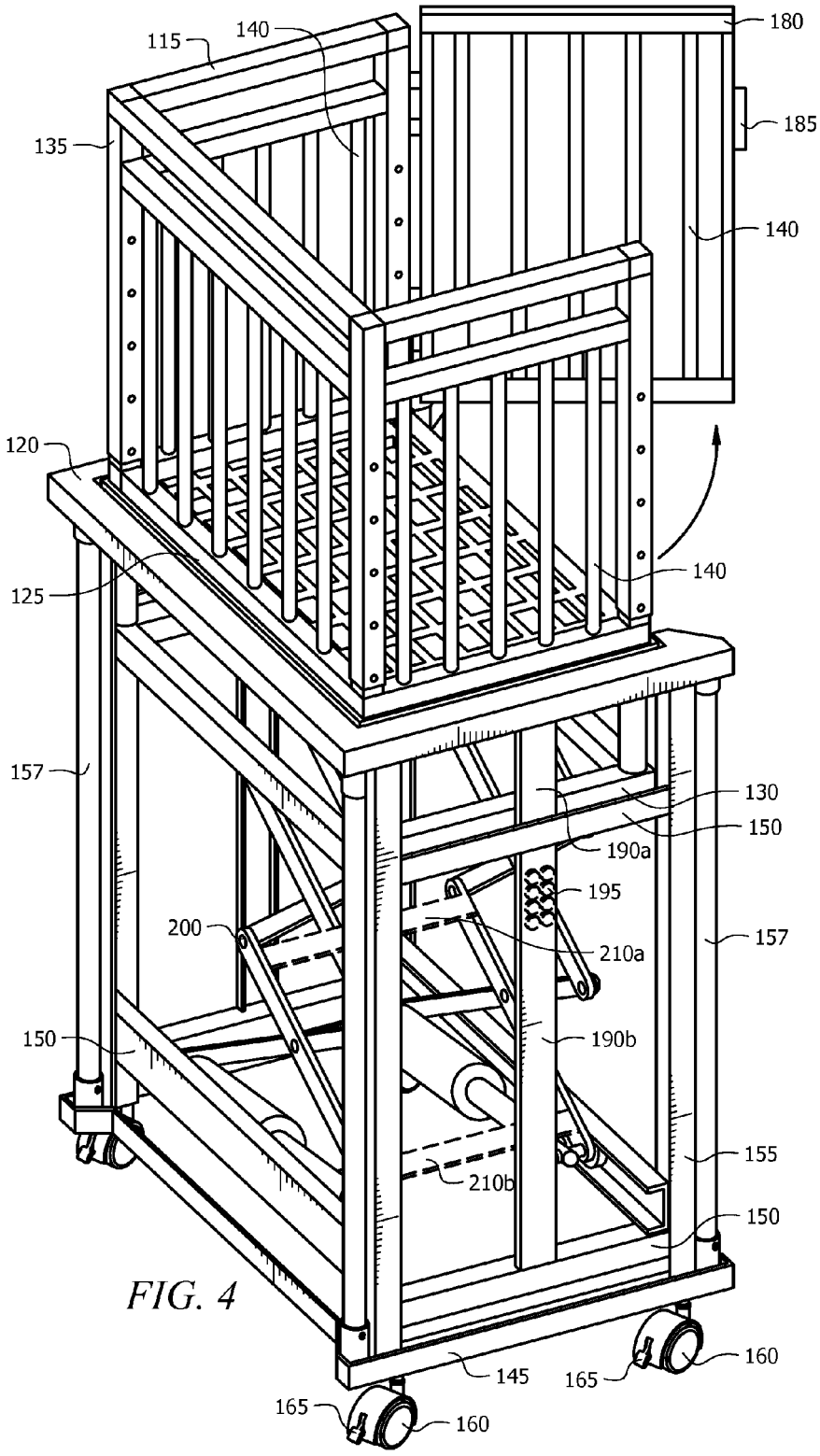
FIG. 4 illustrates an isometric view of an exemplary embodiment of mechanical lift in accordance with the disclosed principles in the fully raised position, and having an option gate and balusters.

Looking now at FIG. 3, illustrated is the lift 100 in a fully raised position. In this embodiment, the opening 170 of the inner frame 105 includes a chain as the enclosing feature 180. FIG. 4 illustrates another isometric view of the mechanical lift 100 in the fully raised position, but this time including a gate structure as the enclosing feature 180. In addition, in this illustrated embodiment, the gate structure 180 also includes the optional balusters 140 discussed above, as well as a latching mechanism 185 to keep the gate 180 securely closed when the lift 100 is in use.

Although not shown in FIGS. 3 and 4, the platform 125 of the lift 100 may extend significantly above the top of the outer frame 110 such that the maximum height achievable by the lift 100 is more than the combined heights of the inner and outer frames 105, 110. In other embodiments, as is illustrated, the interconnection between the inner and outer frames 105, 110 may be configured such that the platform 125 of the inner frame 105 does not extend above the top area of the outer frame 110. In such embodiments, while the maximum height achievable by the lift is consequently limited, such a limitation may provide a safety feature for the lift 100 by limiting the maximum height to a predetermined limit so that users of the lift 100 do not attempt to exceed such a "safe" height. In other embodiments, the power system 215 of the lift 100 may be limited to achieve only a predetermined maximum height, with or without regard to interconnection of the inner and outer frames 105, 110. In any of these exemplary embodiments, the lift 100 may also include optional stabilizers that may be employed near the base of the lift 100 to add horizontal stability to the lift 100 during use. Such stabilizers may be fold-down or otherwise extendable arms, but any type of stabilizing apparatus or multiple devices may also be employed with the disclosed lift 100.

Figure 5:
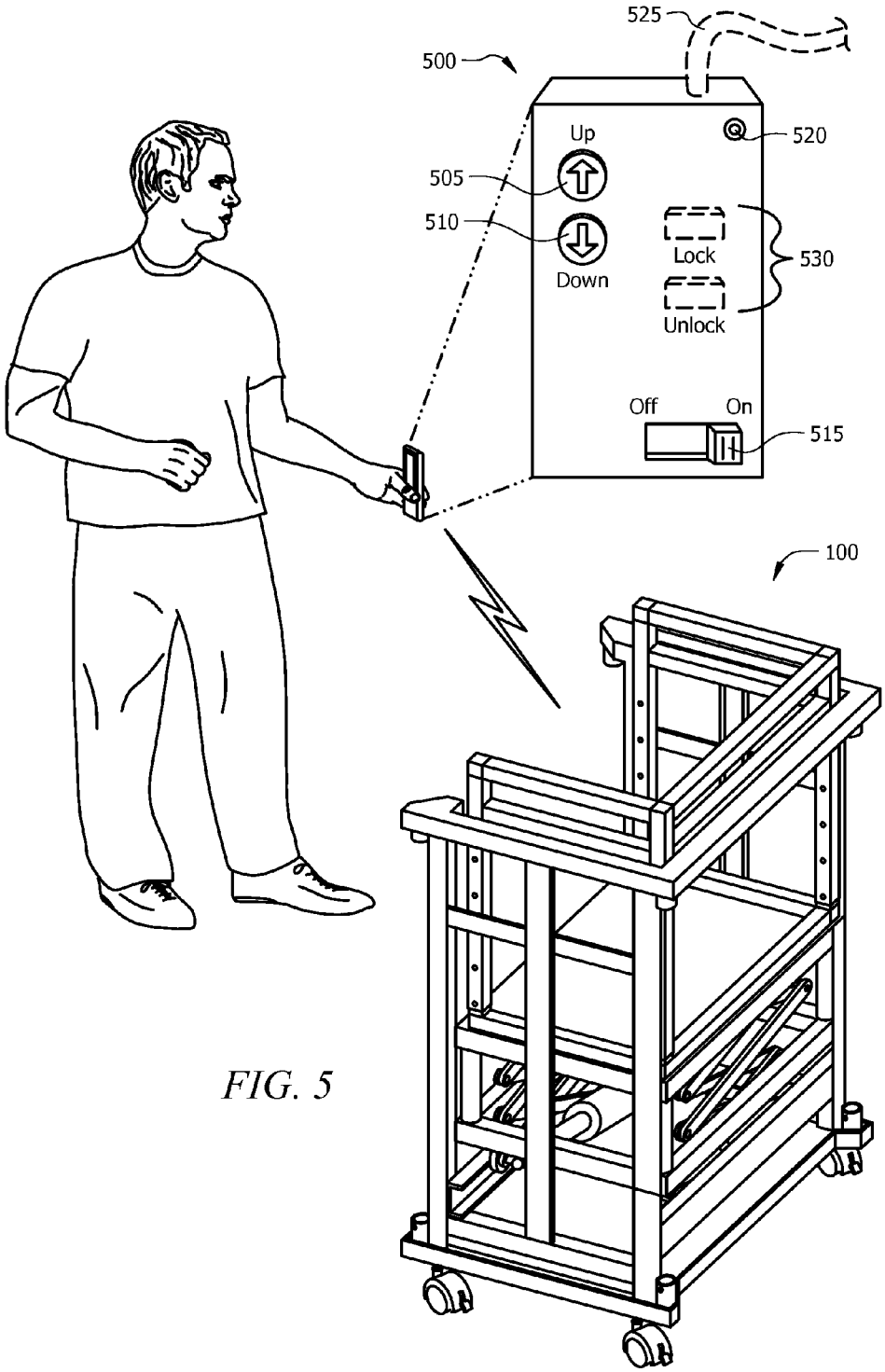
FIG. 5 illustrates an isometric view of an exemplary embodiment of a controller that may be used to raise and lower a lift in accordance with the disclosed principles.

To operate the lift 100, a controller 500 may be included with the lift 100. For example, FIG. 5 illustrates an exemplary embodiment of a controller 500 that may be used to remotely raise and lower the lift 100. Such a controller 500 may include an UP bottom 505 and a DOWN button 510 for raising and lowering the lift 100, respectively. The UP and DOWN buttons 505, 510 may include labels indicating each's function, or may even be shaped in the form of up and down arrows to indicate their functions. Additionally, the UP and DOWN buttons 505, 510 may be configured to only operate when each button is held in a depressed position, with the corresponding raising or lowering function halted when the depressed button is released. Such embodiments could provide an enhanced safety feature for the lift 100 in situations where the user drops or otherwise loses control of the controller 500.

In other embodiments, after pressing each of the UP and DOWN buttons 505, 510 once, their respective functions for the lift 100 may be provided until the activated button is pressed a second time to stop the motion of the lift 100. In still other embodiments, the controller 500 may include a STOP switch (not illustrated) which when depressed would cease the raising or lowering movement provided by the UP and DOWN buttons 505, 510. Moreover, in yet other embodiments, although separate UP and DOWN buttons 505, 510 are illustrated on the controller 500, the up and down functions may also be provided by a single button (not illustrated) where a first push of the single button may cause the inner frame 105 to raise, while a second push of the button may cause it to stop. Thereafter, a third push of the button can cause the inner frame 105 to lower. Of course, any number of operational configurations may be provided for the buttons included on the controller 500, and thus the disclosed principles are not limited to any single configuration of button and/or operational functions.

Such a controller 500 may also include a power button or switch 515 to activate the power supply of the lift mechanism 200 so that the lift 100 is readied for use. The inclusion of a power button or switch 515 can provide a safety mechanism for the user such that the lift 100 will not accidently be operated by a user or someone else inadvertently touching the operational buttons on the controller 500. In addition, a power indicator light 520 may also be included on the controller 500. Such an indicator light 520 may be configured to illuminate when power is being supplied to the lifting mechanism 200, and then not illuminate when there is no power being supplied. Alternatively, the indicator light 520 may be configured to illuminate in one color during operation of the lift 100, and then illuminate in a different color when the lift 100 is not in motion but power to the lifting mechanism 200 is still being supplied. Still further, separate indicator lights (not illustrated) may be provided for the various functions of the lift 100. For example, one indicator light may be present to illuminate during the raising of the inner frame 105, and a different indicator light may be present to illuminate during the lowering of the inner frame 105. As with the buttons provided on the controller 500, the disclosed principles are not limited to any single configuration of indicator light or lights for illuminating during the various operational functions of the lift 100.

Furthermore, the controller 500 may either be handheld, as in the illustrated embodiment of FIG. 5, or it may be affixed to a part of the lift 100 that is easily reached by a user mounting the lift 100. In embodiments that employ a handheld controller 500, the controller 500 may either be tethered to the lift 100 using a cord 525, or it may be wireless. Still further, the controller 500 may actually be embodied as a software application, such an application for a mobile device. For example, the controller 500 may be a mobile application installed and operated from the user's mobile telephone or computer tablet, as desired. Moreover, the controller 500 may also include a locking feature 530 to prevent authorized use of the lift 100. Such a locking feature 530 may be embodied as switches or buttons on the controller 500, or may even be a lock (with a corresponding key) on the controller 500. In other embodiments, the locking feature 530 may be a "lockbox" housing the controller 500 and mounted to the lift 100, or it may be a keypad on the controller 500 having a secret combination known only to authorized users. In other embodiments, RFID or another type of proximity-based device, such as a near-field communication device, may be employed to permit only authorized uses to have access to operate the controller 500. Any such embodiment(s) provides a further safety and/or security enhancement as only authorized users could be programmed or otherwise permitted to use the lift 100. As before, the disclosed principles are not limited to any particular embodiment of controller 500, and instead the principles disclosed herein are broad enough to encompass any of a number of controller 500 configurations and connections to the lift 100.

Figure 6A:
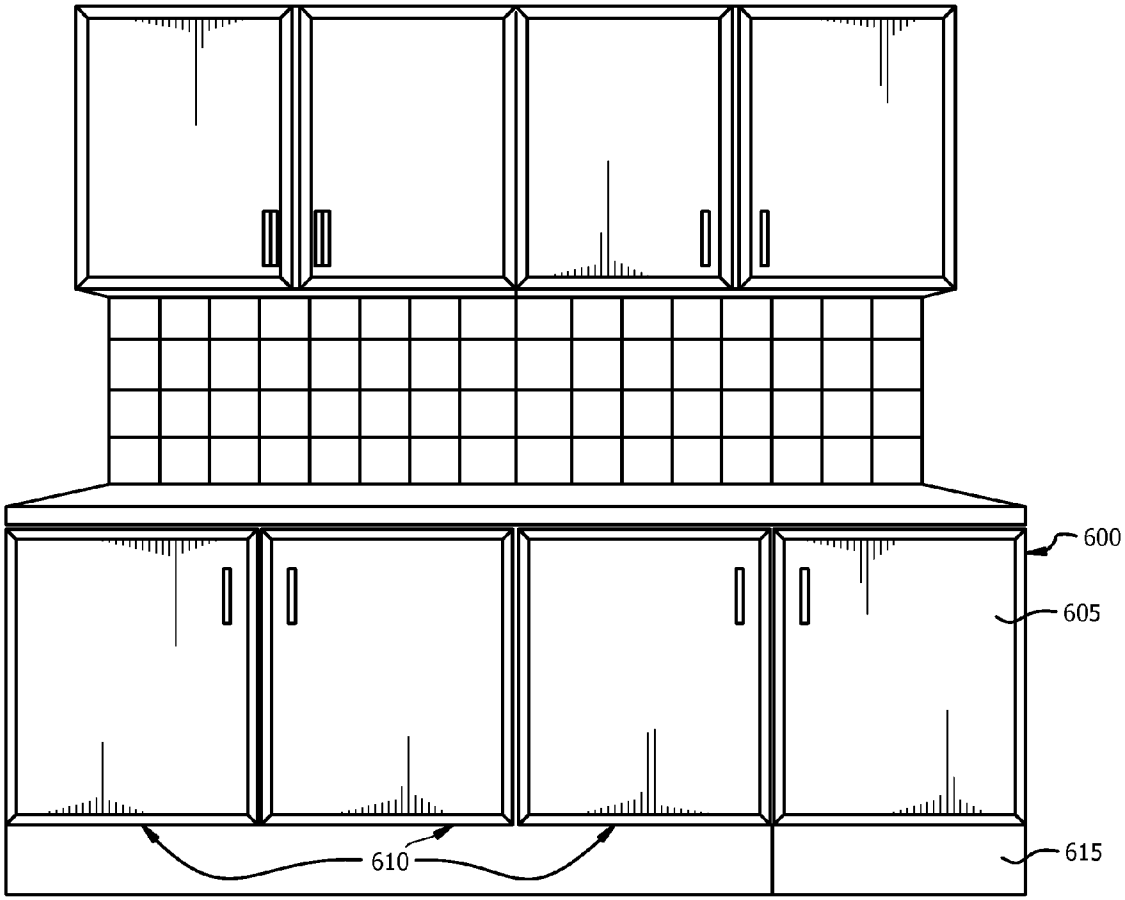
FIGS. 6A and 6B illustrate isometric views of an exemplary embodiment of a lift in accordance with the disclosed principles stored in, and removable from, a false cabinet.
Figure 6B:
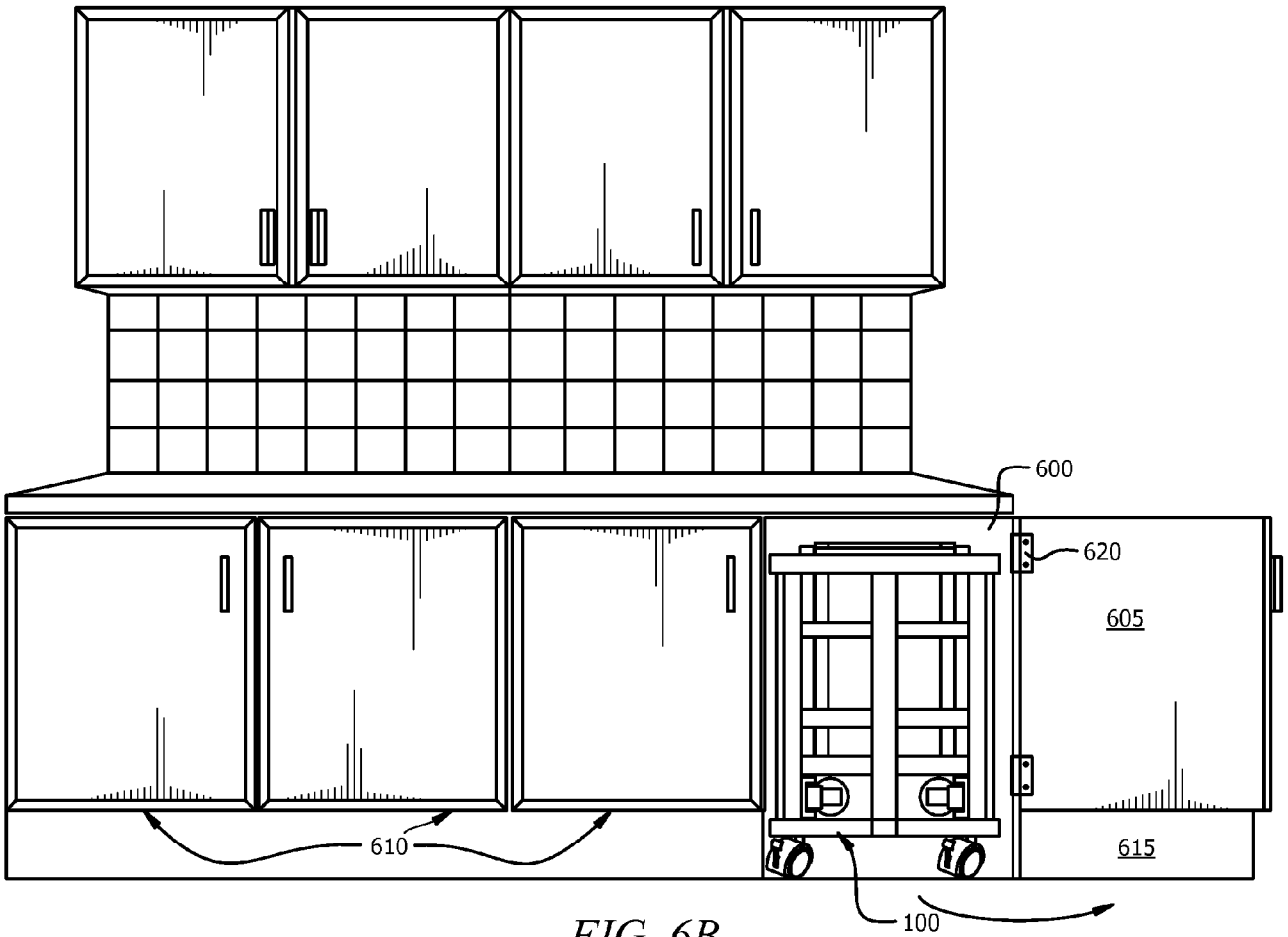

Turning next to FIGS. 6A and 6B, illustrated is an exemplary embodiment of the 100 lift being stored in, and also removable from, a false cabinet 600. FIG. 6A illustrates the false cabinet 600 in the closed position, while FIG. 6B illustrates the false cabinet 600 in the opening position. The false cabinet 600 may be any type of cabinet, such as a kitchen cabinet or a garage cabinet, capable of housing the lift 100 therein. The false cabinet 600 may include a door 605 that closes off the storage area for the lift 100. The size of the storage area housing the lift 100 is selected to easily store the lift 100, as well as permitting its movement to a from the storage area.

The look and design of the storage cabinet 600 may be selected to match the surrounding cabinets 610. In such embodiments, the storage area for the lift 100 is camouflaged to ordinary observers, thus providing a seamless appearance in the room where the lift 100 is being stored. In some embodiments where the surrounding cabinets include drawers above the cabinet openings, the door 605 of the cabinet 600 may also include a false drawer front (not illustrated), and false kickplate 615, in addition to the false cabinet door front, all of which may also be selected to match the surrounding cabinets 610 thereby enhancing the camouflage of the storage area for the lift 100. As illustrated, the door 605 of the false cabinet 600 may include a plurality of hinges 620 that allow the door 605 to swing open and closed from one end. In alternative embodiments, the door 605 may be mounted with rails or other similar sliding mechanisms that permit the door 605 to be moved perpendicularly in and open with respect to the surrounding cabinets 610. In yet other embodiments, the door 605 of the false cabinet 600 may be mounted to a side of the lift 100 such that as the lift 100 is positioned fully within the storage area, the false door 605 aligns with the surrounding cabinets 610 to provide the camouflage to the storage area. Of course, any type of mounting technique for moving the door 605 with respect to the rest of the false cabinet 600 may also be provided without departing from the broad scope of the disclosed principles.

Figure 6C:
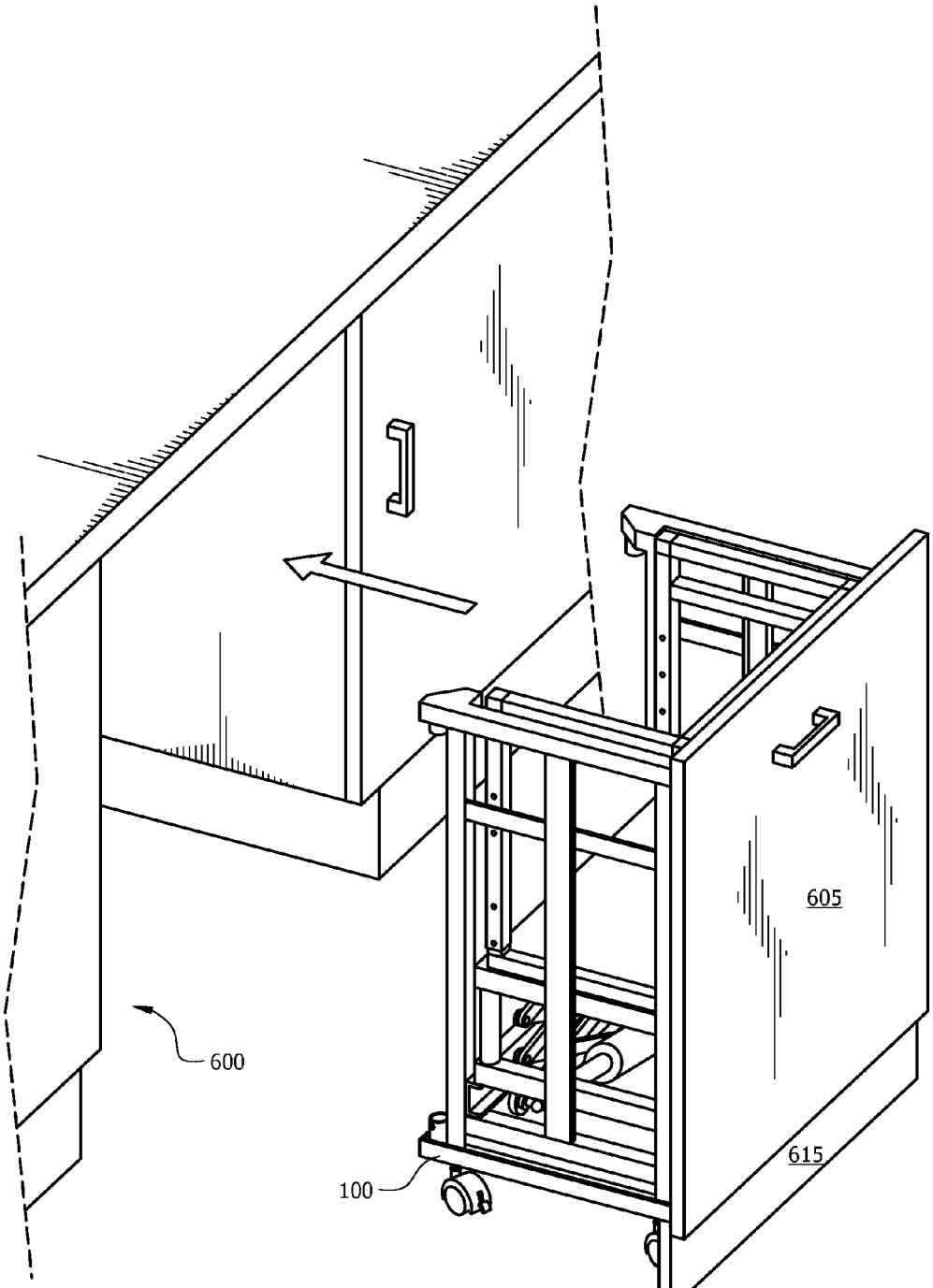
FIG. 6C illustrates an alternative embodiment of a lift in accordance with the disclosed principles placeable within a false cabinet attached thereto.
Figure 6D:
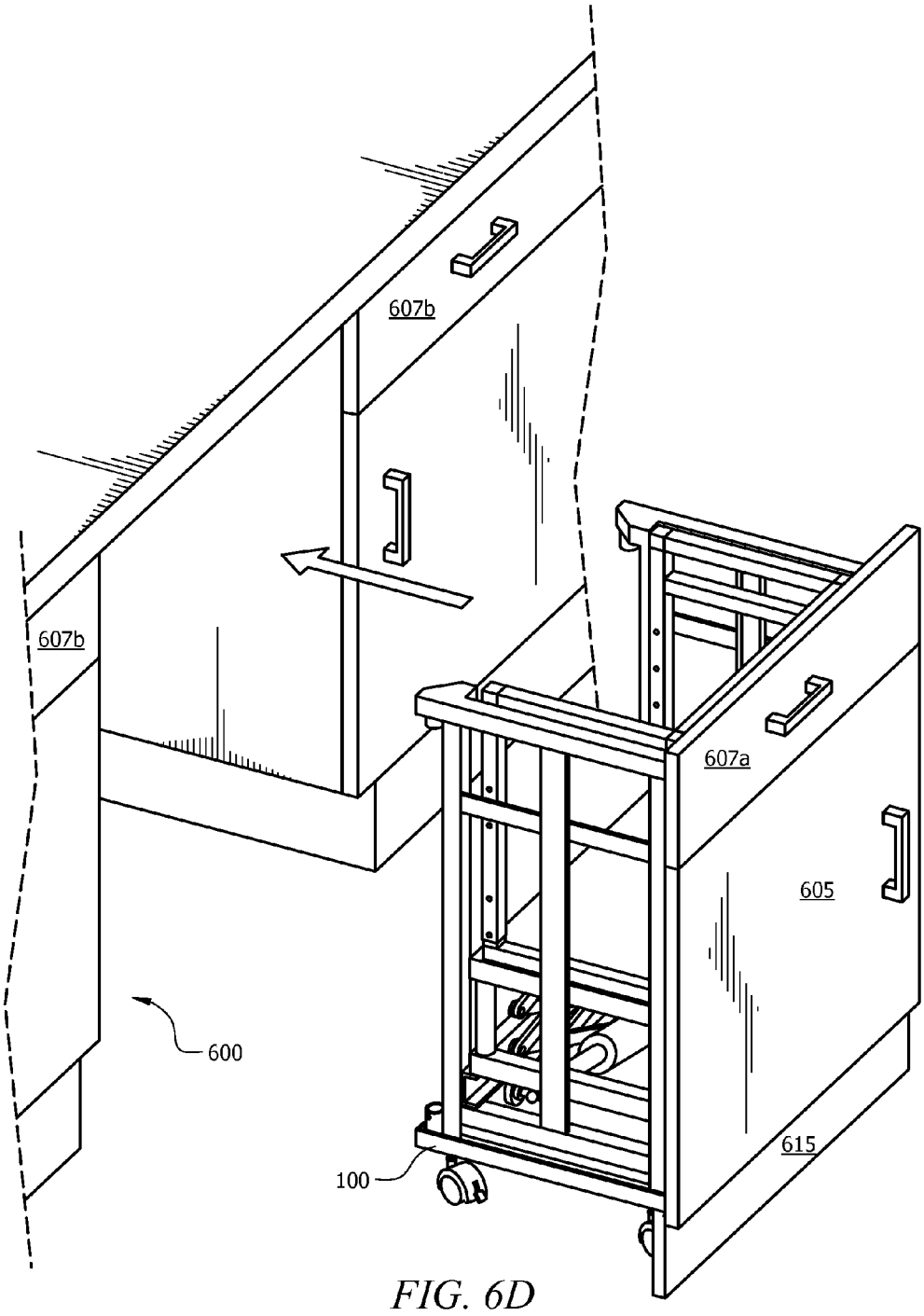
FIG. 6D illustrates another alternative embodiment of a lift in accordance with the disclosed principles having a false drawer front and a false cabinet door attached thereto.

Looking briefly at FIG. 6C, illustrated is an alternative embodiment of the storage of the lift 100 within a false cabinet 600. Specifically, in such embodiments, door 605 of the false cabinet 600 maybe attached directly to the lift 100, rather than being attached to a framework of an adjacent cabinet as illustrated in FIG. 6B. The door 605 may be affixed to the lift 100 at a proper location on the lift 100 so that when the lift 100 is stored within the false cabinet 600, the affixed door 605 fits substantially seamlessly with the surrounding cabinet(s) to camouflage the storage of the lift 100 in the cabinet 600. Additionally, the affixed door 605 maybe removably attached to the lift 100 such that it may be removed while the lift 100 is being moved or is in use. Such embodiments would allow the door 605 to be protected from damage or otherwise interfere with the movement or use of the lift by simply removing it from the lift 100 when desired. Additionally, as illustrated in FIG. 6D, some embodiments of the disclosed lift, where the surrounding cabinets 610 include drawers 607*b* above the cabinet doors, the false door 605 on the lift may also inlcude a false drawer front 607*a* above the false cabinet door 605.

Figure 7:
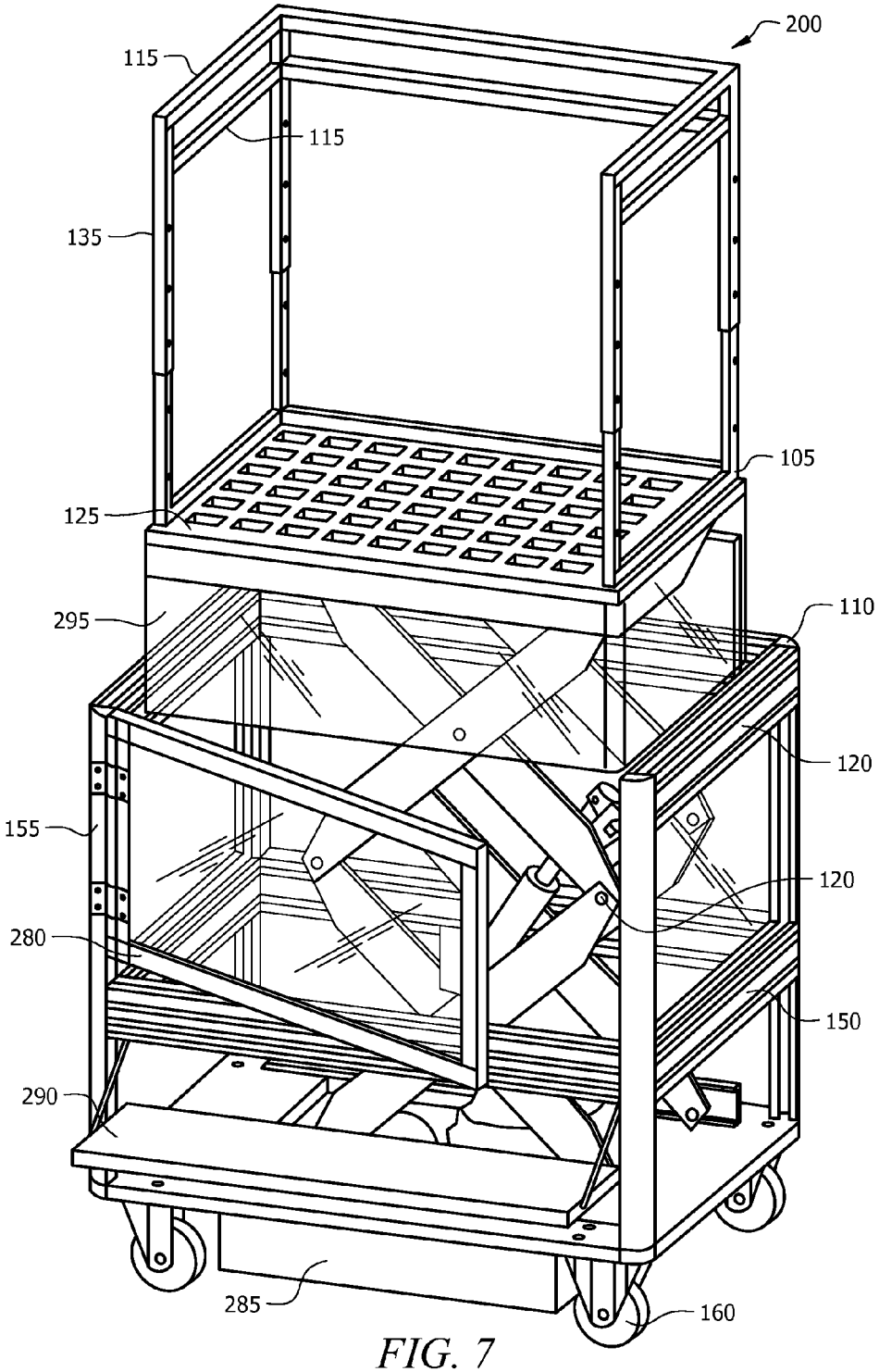
FIG. 7 illustrates an isometric view of an alternative exemplary embodiment of a mechanical lift 200 in accordance with the disclosed principles.

Looking now at FIG. 7, illustrated is an isometric view of an alternative exemplary embodiment of a mechanical lift 200 in accordance with the disclosed principles. This embodiment of the lift 200 again includes both an inner frame 105 and an outer frame 110, with the inner frame 105 sized and configured to be received within the perimeter of the outer frame 110. The inner frame 105 may include one or more inner handrails 115 and the outer frame 110 may include an outer handrail 120, and those handrails 115, 120 may be aligned when the lift 100 is in the fully lowered position.

The inner frame 105 in this embodiment of the lift 200 again includes a platform 125 on which a user stands when using the lift 100. The platform 125 is again supported by vertical support members 135 extending upward to define outer edges of the inner frame 105 and ultimately supporting the inner handrail 115. The vertical support members 135 of the outer frame 110 in this embodiment are also provided with a more curvilinear surface, but this is simply of aesthetic purposes and such shape for the vertical support members 135 is not necessarily required. Moreover, the vertical support members 135 may be adjustable, as illustrated by adjustable features 137 provided along a length of the vertical support members 135. These adjustable features 137 could be notches configured to mate with spring-loaded pins, as illustrated in this embodiment, or any other type of adjustable feature 137 may be employed. With such adjustable features 137, the height of the inner frame 105 may be adjusted with respect to the platform 125, for example, depending on the height of the user employing the lift. Moreover, automated adjustable features 137 may also be employed, rather than the illustrated manual features of FIG. 7.

Attached to the base support frame 145 of the outer frame 110 may again be wheels 160 or any other friction reducing members that permit the lift 200 to be easily moved by a user. Also, locking members, either manually operated or automatic as discussed in detail above, may also be included on the wheels 160, as discussed in more detail above. The outer frame 110 once again also includes an outer opening 170 on the front side of the lift 100, which allows a user to step through the opening 170 to mount the lift. The inner frame 105 also includes inner opening 175 on its front sides, which is also sized for allowing a user to walk through when mounting the lift 100. As before, the inner opening 175 is aligned with and is substantially coextensive with the outer opening 170 of the outer frame 110. In this illustrated embodiment, the inner opening 175 also includes an enclosing feature provided for enhancing a user's safety when mounting the lift 200 for use. Specifically, in this embodiment, the enclosing feature is a door 280 extending across the inner opening 175 of the inner frame 105. The door 280 may include a transparent or semi-transparent panel covering the door 280, as illustrated in FIG. 7, or may again include balusters as in the embodiment of a lift described above.

The lifting mechanism 200 in this alternative embodiment of the lift 200 illustrated in FIG. 7 is again a "scissor type" or "scissor lift" mechanism 200, comprising the use of linked, folding supports 205 in a criss-cross "X" pattern. As before, however, other types of lifting mechanisms may also be employed to lift the inner frame with respect to the outer frame, as discussed in detail above. In this embodiment, however, a single movement mechanism, e.g., piston 215, is employed, which again may be a hydraulic or pneumatic based power system. In some embodiments, a pan 285 may be provided at the bottom of the lift 200 Also, in this illustrated embodiment, there are no guiderails used to physically connect the inner frame 105 to the outer frame 110, as there was in other embodiments discussed above. Of course, the guiderails may be included, if desired.

An additional feature provided in this alternative embodiment of a lift 200 constructed in accordance with the disclosed principles is a flip-down step 290 on the front of the lift. Specifically, the step 290 may be provided at approximately a mid-point between the floor on which the lift 200 sits and the height of the platform 125 when the inner frame 105 is in its fully lowered position. While merely optional, the step 290 provides the user an easier means of stepping up onto the platform 125 to employ the lift 200. Moreover, if the step 290 is provided as a flip-down mechanism as in the illustrated embodiment of FIG. 7, the step 290 maybe flipped up into its "closed" position so as to hide it from view, as well as to provide the lift 200 with a sleek profile that would not allow the step 290 to interfere with the movement of the lift 200. Furthermore, a "skirt" 295 may also be provided surrounding the base of the inner frame 105. Specifically, such a skirt 295 may be constructed of semi-transparent or opaque panels (which in FIG. 7 are shown as semi-transparent) so as to hide portions of the lifting mechanism 200 during lift use, so as to provide a more aesthetically pleasing appearance of the lift 200 when the platform 125 is raised above the top rail 120 of the outer frame 110 during use. Of course, other materials, whether stiff or flexible, may also be used for the skirt 295, and no limitation to any particular material for the skirt 295 is implied.

While various embodiments in accordance with the principles disclosed herein have been described above, it should be understood that they have been presented by way of example only, and not limitation. Thus, the breadth and scope of this disclosure should not be limited by any of the above-described exemplary embodiments, but should be defined only in accordance with any claims and their equivalents issuing from this disclosure. Furthermore, the above advantages and features are provided in described embodiments, but shall not limit the application of such issued claims to processes and structures accomplishing any or all of the above advantages.

Additionally, the section headings herein are provided for consistency with the suggestions under 37 C.F.R. 1.77 or otherwise to provide organizational cues. These headings shall not limit or characterize the invention(s) set out in any claims that may issue from this disclosure. Specifically and by way of example, although the headings refer to a "Technical Field," the claims should not be limited by the language chosen under this heading to describe the so-called field. Further, a description of a technology in the "Background" is not to be construed as an admission that certain technology is prior art to any embodiment(s) in this disclosure. Neither is the "Summary" to be considered as a characterization of the embodiment(s) set forth in issued claims. Furthermore, any reference in this disclosure to "invention" in the singular should not be used to argue that there is only a single point of novelty in this disclosure. Multiple embodiments may be set forth according to the limitations of the multiple claims issuing from this disclosure, and such claims accordingly define the embodiment(s), and their equivalents, that are protected thereby. In all instances, the scope of such claims shall be considered on their own merits in light of this disclosure, but should not be constrained by the headings set forth herein.

What is claimed is:

1. An automated personal lift for lifting a user to a desired height, the lift comprising:

an outer frame comprising a horizontal base support and an outer handrail supported above a perimeter of the horizontal base support by a plurality of outer vertical supports coupled to the horizontal base support, the outer handrail comprising a first opening having a width sufficient for a human user to step through the outer handrail when using the lift;

an inner frame positioned within the outer frame and comprising a horizontal platform configured to support the user and an inner handrail supported above a perimeter of the platform by a plurality of inner vertical supports coupled to the platform, the inner handrail comprising a second opening aligned with the first opening in the outer handrail, the second opening having a width sufficient for a human user to step through the inner handrail when using the lift;

an automated scissor lift mechanism coupling the outer frame to the inner frame, and configured to raise and lower the inner frame with respect to the outer frame;

at least one guide moveably connecting the outer frame to the inner frame, the at least one guide configured to provide horizontal stability between the outer and inner frames during the raising and lowering;

a plurality of friction reducing members attached to the base support and configured to allow the lift to be moved to a different location by the user; and a false cabinet front having a height at least coextensive with a height of the outer frame and a width at least coextensive with a width of the lift, the false cabinet front comprising at least a cabinet door and is attached to a side of the outer frame opposite a side having the first opening, the lift operable to be placed within a group of cabinets having substantially similar cabinet fronts.

2. An automated personal lift in accordance with claim 1, wherein the automated scissor lift mechanism based on a pantograph linkage having at least one fluid driven ram coupled to the horizontal base support at one end and to a lower linkage element of the pantograph linkage.

3. An automated personal lift in accordance with claim 1, further comprising a plurality of vertical balusters affixed between the platform and the inner handrail between the inner vertical supports.

4. An automated personal lift in accordance with claim 1, wherein the scissor lift mechanism comprises at least two fluid-driven rams.

5. An automated personal lift in accordance with claim 1, further comprising a controller configured to operate the scissor lift mechanism when activated by a user.

6. An automated personal lift in accordance with claim 1, wherein the outer handrail is at a height substantially equal to a height of the inner handrail when the lift is in a fully lowered position.

7. An automated personal lift in accordance with claim 1, wherein the false cabinet front further comprises a false kick plate below and adjacent to a bottom of the false cabinet door.

8. An automated personal lift in accordance with claim 1, wherein the plurality of friction reducing members comprises a plurality of wheel members.

9. An automated personal lift in accordance with claim 8, wherein at least one of the wheel members further comprises a locking mechanism configured to prevent rolling of the wheel when in a locked position.

10. An automated personal lift in accordance with claim 9, wherein the locking mechanism is automatic in response to weight received on the platform.

11. An automated personal lift in accordance with claim 9, wherein the locking mechanism is an electric locking mechanism which operates automatically in response to lifting of the inner frame via activation of the automated lifting mechanism.

12. An automated personal lift in accordance with claim 1, wherein the first opening further comprises a gate.

13. An automated personal lift in accordance with claim 1, wherein the false cabinet front further comprises a false kick plate below and affixed to a bottom of the false cabinet door.

14. An automated personal lift in accordance with claim 1, wherein the false cabinet front further comprises a false drawer front above and affixed to a top of the false cabinet door.

15. An automated personal lift in accordance with claim 1, wherein the false cabinet front is removably attached to the lift.

16. An automated personal lift in accordance with claim 1, further comprising a plurality of transparent panels, each affixed to a corresponding side of the inner frame and a corresponding side of the outer frame.

17. An automated personal lift in accordance with claim 1, wherein the locking mechanism is an electric locking mechanism operable with a remote switch.

18. An automated personal lift in accordance with claim 1, wherein the at least one guide comprises at least one pair of interconnected guiderails, wherein a first guiderail of the pair is attached to a bottom area of the inner frame and a complementary second guiderail of the pair is attached to a horizontal support member coupled to the outer frame.

19. An automated personal lift in accordance with claim 1, wherein the at least one guide comprises sliding pairs or members at corresponding corners of the inner and outer frames, wherein first members of each pair are attached to a bottom area at each corner of the inner frame and complementary second members of each pair are attached to an upper area at each corner of the outer frame.

* * * * *

UNITED STATES PATENT AND TRADEMARK OFFICE

CERTIFICATE OF CORRECTION

PATENT NO. : 9,212,038 B1
APPLICATION NO. : 14/508061
DATED : December 15, 2015
INVENTOR(S) : Kelly Presti It is certified that error appears in the above-identified patent and that said Letters Patent is hereby corrected as shown below:

IN THE SPECIFICATION

In Column 1, Line 64, "stored" should be changed to -- store --.

In Column 3, Line 36, "location" should be changed to -- locations --;
Line 45, "primary" should be changed to -- primarily --;
Line 48, "me" should be changed to -- be --.

In Column 5, Line 59, "advantages" should be changed to -- advantageous --.

In Column 6, Line 46, "190b." should be changed to -- 190b may be employed. --.

In Column 7, Line 60, "provide" should be changed to -- provided --.

In Column 8, Line 66, "UP bottom" should be changed to -- UP button --.

In Column 10, Line 22, "opening" should be changed to -- open --;
Line 28, "to a from" should be changed to -- to and from --.

Signed and Sealed this
Fifteenth Day of March, 2016

Michelle K. Lee

Michelle K. Lee
*Director of the United States Patent and Trademark Office*